US005305778A

United States Patent [19]

Traylor

[11] Patent Number: 5,305,778

[45] Date of Patent: * Apr. 26, 1994

[54] AIR GAP APPARATUS

[76] Inventor: Paul L. Traylor, 16591 Milliken Ave., Irvine, Calif. 92714

[ * ] Notice: The portion of the term of this patent subsequent to Jan. 5, 2010 has been disclaimed.

[21] Appl. No.: 999,222

[22] Filed: Dec. 31, 1992

Related U.S. Application Data

[63] Continuation-in-part of Ser. No. 781,751, Oct. 23, 1991, Pat. No. 5,176,165.

[51] Int. Cl.[5] ..... E03C 1/12

[52] U.S. Cl. ..... 137/216; 137/216.1; 137/360

[58] Field of Search ..... 137/216, 216.1, 360

[56] References Cited

U.S. PATENT DOCUMENTS

| | | | |
|---|---|---|---|
| 2,878,826 | 3/1959 | Dolenga | 137/216 |
| 3,411,524 | 11/1968 | Raine et al. | 137/216 |
| 3,716,143 | 2/1973 | Clark . | |
| 3,786,924 | 1/1974 | Huffman . | |
| 3,856,672 | 12/1974 | Boswinble et al. . | |
| 3,929,149 | 12/1975 | Phillips | 137/216 |
| 4,071,445 | 1/1978 | Katayama et al. . | |
| 4,454,891 | 6/1984 | Dreibelbis et al. | 137/216 |
| 4,646,755 | 3/1987 | Traylor . | |
| 4,646,775 | 3/1987 | Traylor | 137/216 X |
| 4,771,485 | 9/1988 | Traylor | 137/216 X |
| 4,812,237 | 3/1989 | Cawley et al. . | |
| 4,856,121 | 8/1989 | Traylor | 137/216 X |
| 4,917,847 | 4/1990 | Solomon . | |
| 4,944,877 | 7/1990 | Maples . | |
| 4,967,784 | 11/1990 | Barhydt, Sr. et al. | 137/216 |
| 5,006,234 | 4/1991 | Menon et al. . | |
| 5,176,165 | 1/1993 | Traylor | 137/216 X |

*Primary Examiner*—Gerald A. Michalsky

*Attorney, Agent, or Firm*—Joseph F. McLellan

[57] ABSTRACT

An air gap apparatus for plumbing applications such as reverse osmosis (RO) units and other systems in which reject water empties at a relatively slow rate into a drain line. The apparatus can be incorporated in an under-the-counter unit or in a countertop embodiment which eliminates umbilical connections between the RO unit and the kitchen faucet and sink drain. The apparatus has a conventional air gap to protect against back siphoning and against high velocity backflow from the drainage line. It uses a deflector wall in combination with a supplemental opening and one or more backflow restrictors to slow and shunt any backflow to atmosphere. Different styles of countertop and wall mount installations are disclosed, as well as various deflector walls and back flow devices.

30 Claims, 10 Drawing Sheets

FIG. 10
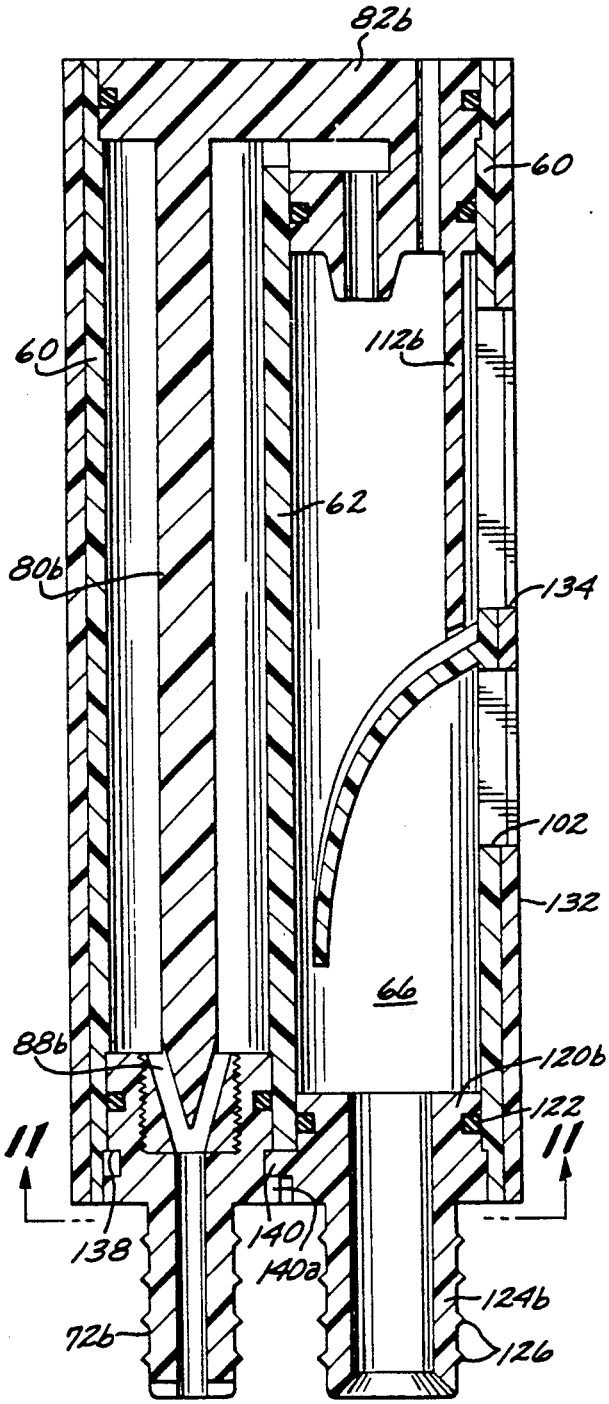
FIG. 11
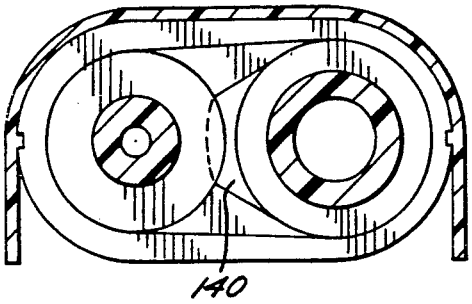
FIG. 12
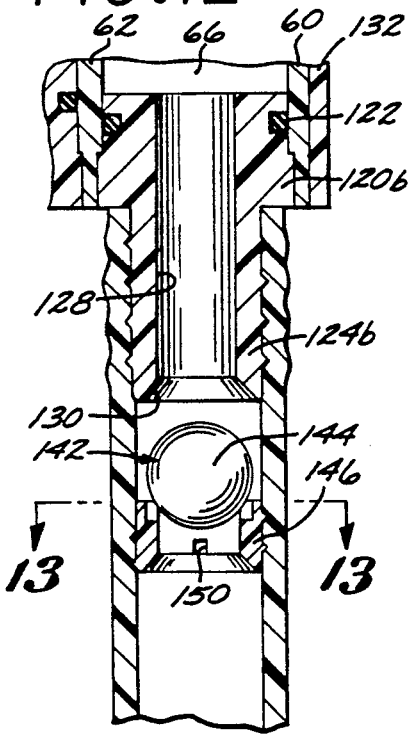
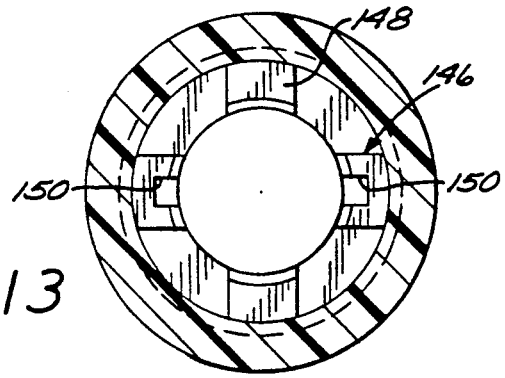
FIG. 13

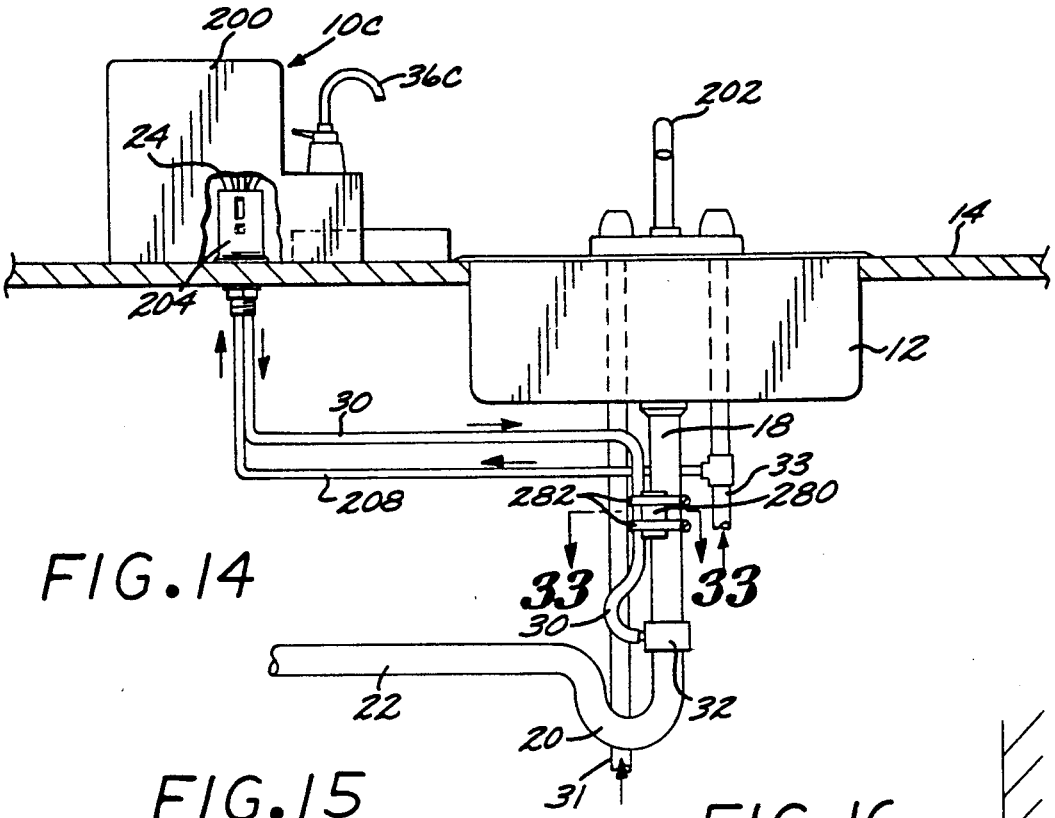
FIG. 14
FIG. 15
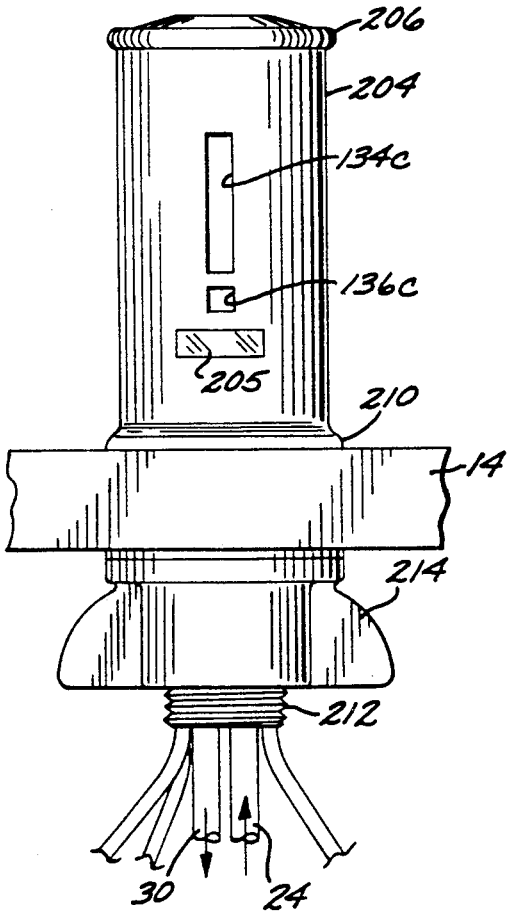
FIG. 16
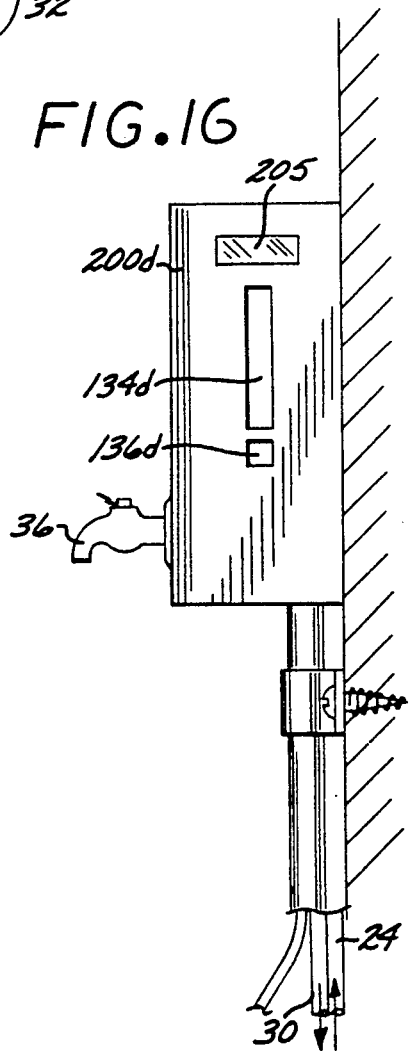

FIG. 17
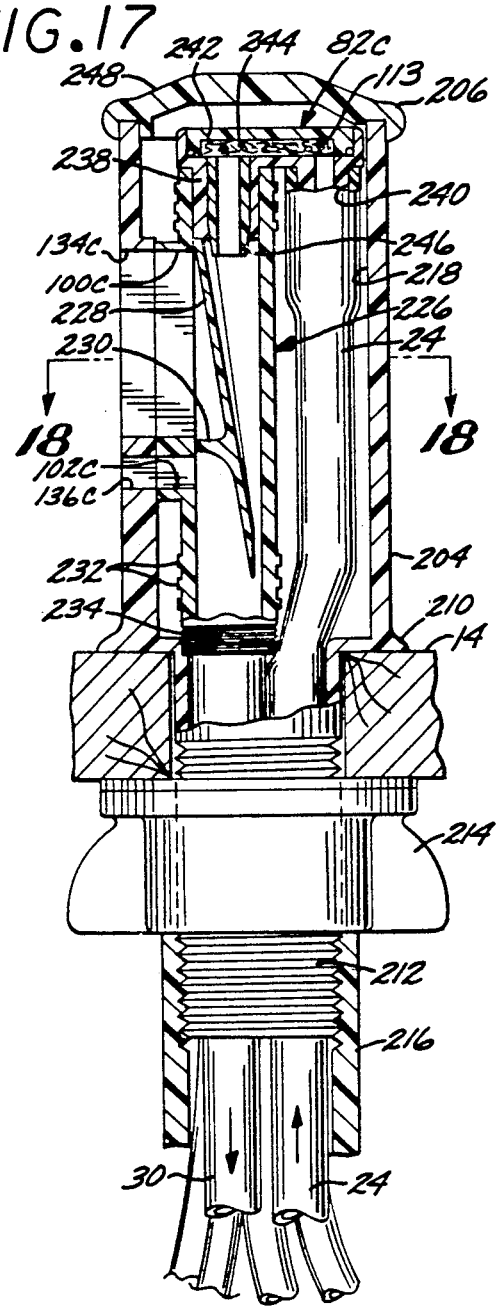
FIG. 18
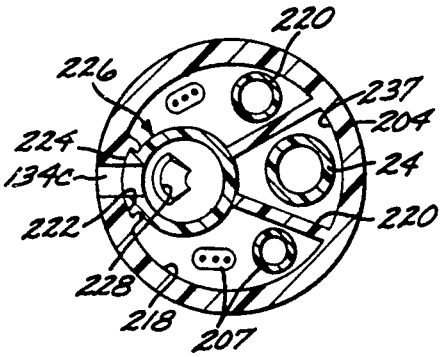
FIG. 19
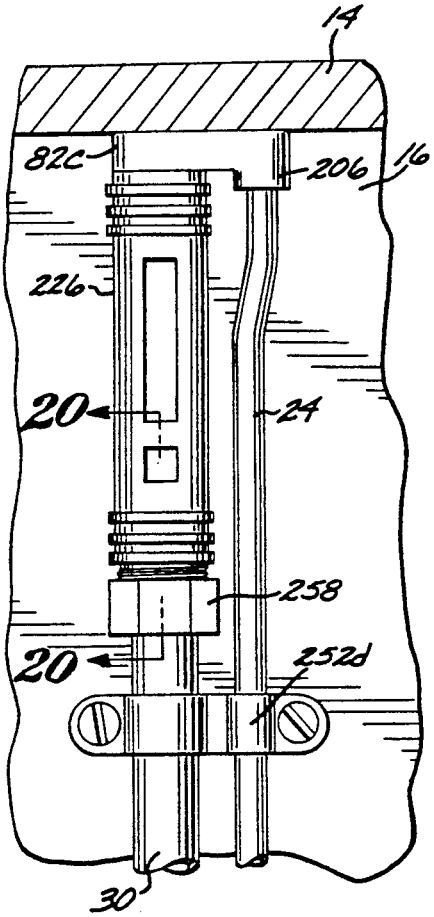
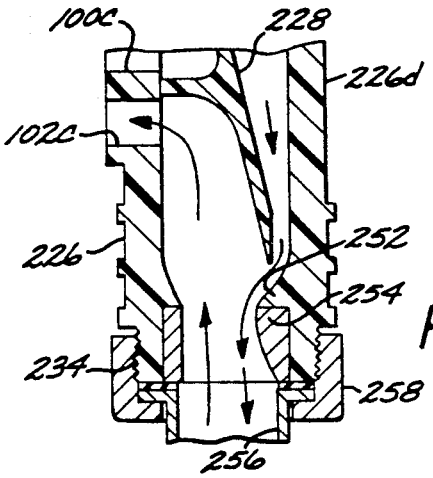
FIG. 20

FIG. 28
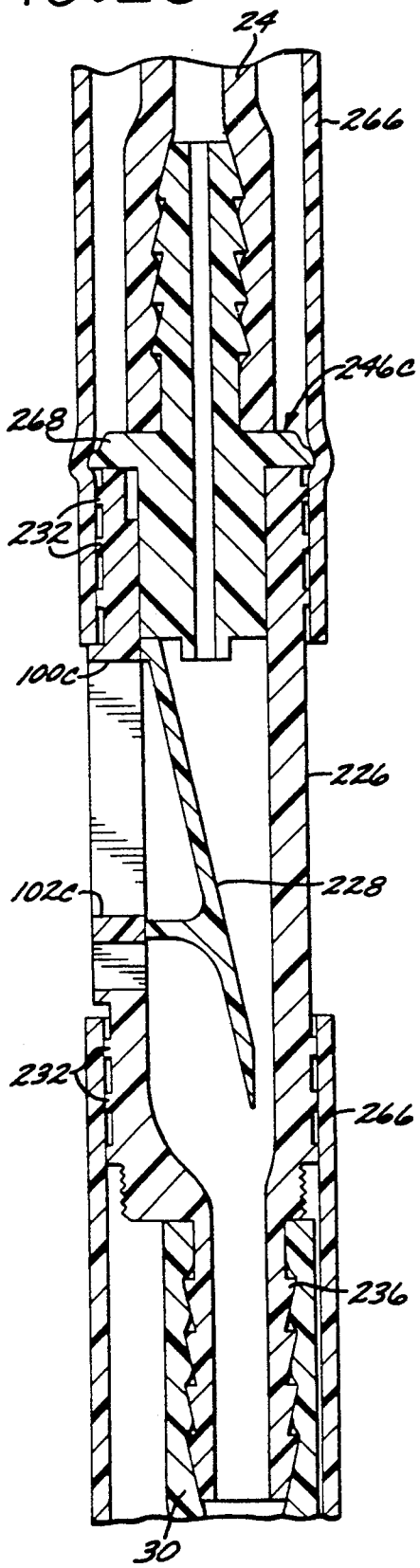
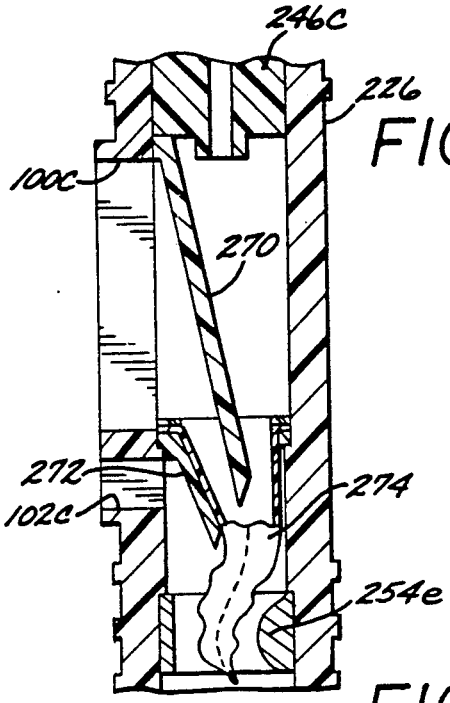
FIG. 29
FIG. 30
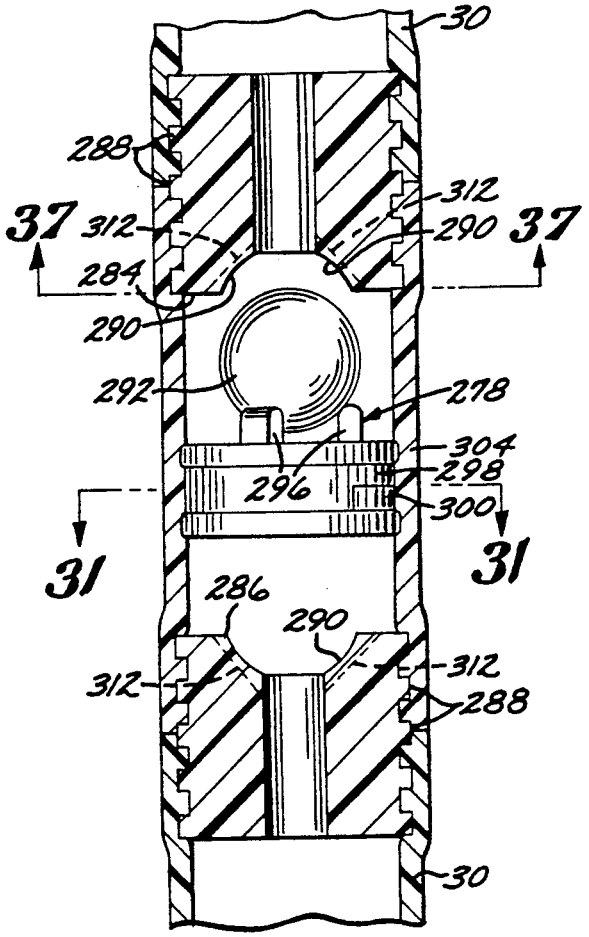

AIR GAP APPARATUS

CROSS REFERENCE TO RELATED APPLICATION

This application is a continuation-in-part of my copending parent patent application Ser. No. 07/781,751, filed Oct. 23, 1991, now U.S. Pat. No. 5,176,165, for AIR GAP APPARATUS.

Further embodiments are disclosed for mounting an air gap apparatus in a reverse osmosis countertop, an under-the-counter installation, or a wall installation. Further embodiments of deflector walls and backflow protection devices are also included.

BACKGROUND OF THE INVENTION

Field of the Invention

The present invention relates to a vacuum breaker or air gap apparatus for liquid dispensing equipment, and particularly water purification and dispensing systems such as reverse osmosis (RO) units.

DESCRIPTION OF THE PRIOR ART

In a reverse osmosis water unit the source or inlet water passes through a membrane or the like and emerges as purified or potable outlet water. Water that does not pass constitutes waste or reject water which empties into an associated drainage system. Any uncontrolled backflow from the drainage system thus can enter and contaminate the RO membrane and associated structure. For this reason, wherever there is drainage from an RO unit into a sewer system, plumbing codes require that backflow prevention devices such as air gap devices be used. These are designed to prevent backsiphoning or backflow of contaminated water into the RO unit.

In this regard, contaminated water is considered to be any water downstream of the RO unit, and an acceptable backflow prevention device must prevent entry of such downstream water into the RO unit under all conceivable conditions of operation.

Plumbing codes require an air gap type of backflow preventer to have an air gap or vertical height opening of at least one inch. This prevents the backsiphoning type of back flow in most situations. However, there are instances when a pressure differential between the RO unit and the drainage system can develop almost instantaneously, resulting in a high velocity flow of contaminated water across the air gap and into the RO unit and potable water system.

The use of a conventional check valve located in the drain line between the RO unit and the house drain or waste piping would prevent such an instantaneous backflow, but such check valves are not usually allowed by plumbing codes. The rationale is that foreign matter in the backflow could clog such a valve and prevent it from seating properly.

The drain line from the kitchen sink is normally used to carry off the waste water from a residential RO unit. This line periodically becomes blocked by waste matter so that contaminated waste water rises toward the RO unit. Such blockages are becoming more frequent because water conservation devices such as low water consumption toilets and restricted flow rate shower heads are being increasingly used. These tend to cause more blockages because they reduce the water flow rate and the water flushing action through the drain lines. Once a blockage occurs, backflow from the drain water typically rises or backflows at a relatively slow rate because of the large size of the usual drain line. However, this flow becomes a high velocity backflow in the smaller diameter waste water conduit of an RO unit and can shoot upwardly past the air gap opening and contaminate the RO unit water. Of course, when the backflow is pressure induced, the rate of backflow is even greater.

Many manufacturers of RO systems fit their equipment with air gap devices, but a considerable number do not. Further, even when such devices are provided they do not always provide the one inch vertical air gap required by plumbing codes. Also, as previously indicated, an air gap large enough to allow the relatively slow flowing RO waste water to flow out of the air gap to atmosphere cannot accommodate a forcible, high velocity backflow from the larger drain line.

A pressing need exists for an inexpensive, relatively compact air gap device adapted for mounting separately of the water dispensing faucet, and conveniently accessible for servicing. A desirable air gap should permit usual RO waste water flow, but incorporate a means for preventing contamination of the RO system by high velocity backflow from a blocked drainage line.

A backflow restrictor would be desirable to provide added protection against backflow.

A suitable air gap device should preferably be available as a separate item for installation within an RO unit, either as original equipment or as an after market addition.

The air gap device should also be "universal" in the sense that it could be installable using easy, push-on fittings to attach it to various sizes and types of conduits.

Special problems are presented when air gap devices are to be associated with portable or countertop RO units. Such units are usually placed on a kitchen sink countertop, and include a pair of umbilical conduits. One of these is connected to the sink spout to supply water to the RO unit, the other empties the RO waste water into the sink drain. Normal use of the sink spout is made awkward, and the relatively constant discharge of RO waste water is annoying to a householder.

The usual countertop RO unit also does not provide sufficient room for adequate size filters, or for ultraviolet treatment of the RO generated water. A desirable system should enable ultraviolet equipment to be incorporated in countertop RO units, and provide for through-the-counter electrical conduits and the like.

In the prior art, my U.S. Pat. No. 4,646,775, issued Mar. 3, 1987, discloses an air gap apparatus capable of preventing back flow from a drain line. However, the backflow restrictor employed will not satisfy certain plumbing codes. Moreover, the apparatus is not optimally configured for small RO waste water flow.

My U.S. Pat. Nos. 4,771,485 and 4,856,121, issued Sep. 10, 1988 and Aug. 15, 1989, respectively, also disclose air gap devices, but these are designed for incorporation in a faucet fixture. Further, there is no provision for preventing high velocity backflow of contaminated drain line water past the air gap and into the potable water system.

SUMMARY OF THE INVENTION

According to the present invention, a water dispenser air gap apparatus is provided which includes an air gap which prevents backsiphoning and backflow flowing at low or moderate rates from the drain line into the dispenser. In addition, the apparatus preferably includes a flow deflector wall and a supplemental opening operative to divert or shunt exteriorly any high flow rate or high velocity backflow coming from the drain line.

One or more auxiliary vent passages are preferably included to enhance operation of the air gap when a vacuum develops at the inlet part of the system.

The apparatus can be inexpensively molded of plastic or other corrosion resistant material, and includes end fittings which enable easy attachment of the apparatus to the conduits and fittings typically used in RO systems.

The apparatus preferably is used in conjunction with a backflow restrictor to choke off or substantially stop high flow rate backflow from the household drain line. In addition, a filter or screen can be used to keep debris from entering the backflow restrictor and passing upstream to the air gap apparatus.

Various embodiments of the air gap apparatus are illustrated in countertop, under-the-counter, and wall mounted arrangements. Structural arrangements are described to direct and shape the flowing upstream of RO waste water through the air gap apparatus, and to enhance its rate of flow.

The apparatus also preferably includes means, and its internally configured, to enhance the rate of water flow through the apparatus.

Other features and advantages of the invention will become apparent from the follow detailed description, taken in conjunction with the accompanying drawings which illustrate features of the invention.

BRIEF DESCRIPTION OF THE DRAWINGS

FIG. 10 is an enlarged longitudinal cross sectional view of an air gap apparatus similar to that of FIG. 6 except for the manner of mounting the end closures to the housing;

FIG. 11 is a view taken along the line 11—11 of FIG. 10;

FIG. 12 is an enlarged longitudinal cross sectional view of an improved backflow restrictor coupled by means of a conduit to the outlet fitting of the air gap apparatus of FIG. 6;

FIG. 13 is a view taken along the line 13—13 of FIG. 12;

FIG. 14 is a front elevational view of a reverse osmosis (RO) unit mounted on a kitchen countertop adjacent the kitchen sink, and incorporating another form of air gap housing in a through-the-counter body which is disposed within an enclosure;

FIG. 15 is a front elevational view of the air gap housing of FIG. 14 located in a through-the-counter body similar to the body of FIG. 14, but differing in that it includes a top, and it is not housed within an enclosure;

FIG. 16 is a side elevational view of the air gap housing of FIG. 14 located in a wall mounted body;

FIG. 17 is a longitudinal cross sectional view of the air gap housing of FIG. 14, but located in a through-the-counter body like that illustrated in FIG. 15;

FIG. 18 is a view taken along the line 18—18 of FIG. 17, with conduits added to show how such conduits can easily be accommodated in the body;

FIG. 19 is a front elevational view of an air gap housing similar to that of FIG. 17, except that it is attached to a wall beneath the counter of a kitchen sink by a cable clamp;

FIG. 20 is an enlarged detail view taken along the line 20—20 of FIG. 19;

FIG. 28 is a longitudinal cross sectional view of the air gap housing, and illustrating its connection to an axially aligned smaller or larger conduit;

FIG. 29 is a view similar to FIG. 28, but illustrating a modified form of air gap housing incorporating a flexible and collapsible backflow preventer in its lower portion;

FIG. 30 longitudinal cross sectional view of a "universal" style backflow restrictor installed within the cut ends of flexible conduit;

DESCRIPTION OF THE PREFERRED EMBODIMENTS

The present air gap apparatus can be used in various general arrangements, some of which will next be described.

Figure 1:
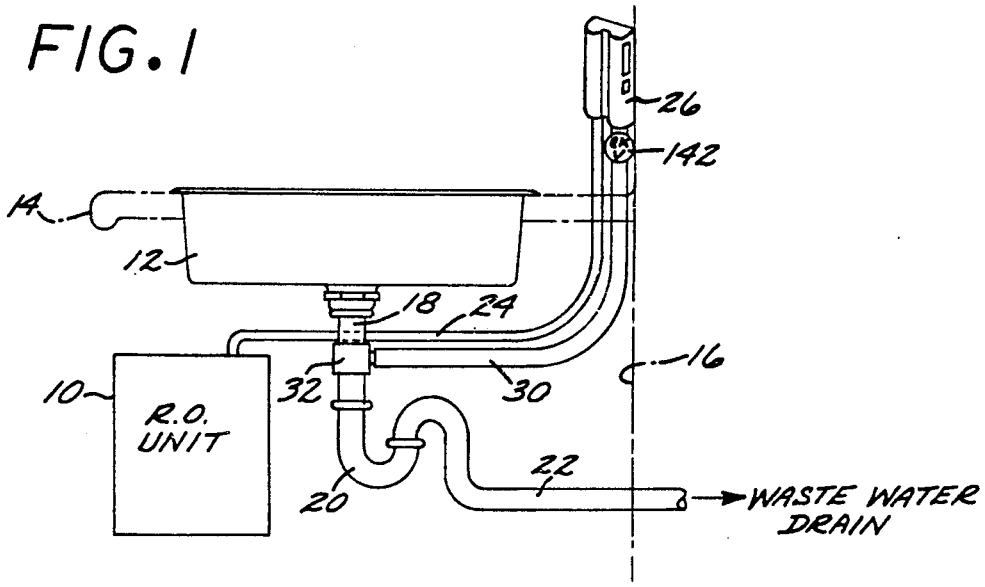
FIG. 1 is a schematic view of the present air gap apparatus in an under-the-counter reverse osmosis (RO) system.

FIG. 1 illustrates a liquid dispenser system comprising an under-the-counter reverse osmosis (RO) unit 10 located beneath a kitchen sink 12 which is mounted in a counter 14. The sink 12 is fixed to a wall 16 and empties into a drain pipe or conduit 18 which is connected to a conventional "P" trap 20. The trap 20 is connected to a waste water drain line 22.

Although not illustrated, the potable water output of the unit 10 is connected by a suitable conduit to a usual faucet or spigot located somewhere on the counter. The reject or waste water from the unit 10 passes into an air gap inlet conduit 24 which is coupled to the air gap apparatus 26 of the present invention.

The air gap apparatus 26 is fastened to the adjacent wall 16 and empties into an air gap outlet conduit 30 which is clamped to the drain conduit 18 by a cylindrical fitting 32. Another arrangement for accomplishing this is described later in connection with FIG. 14.

Water from the outlet conduit 30 flow to the fitting 32, and then into the conduit 18 through a suitable opening (not shown) provided in the conduit 18. A suitable pressure seal (not shown) prevents water from leaking out of the fitting 32.

Figure 2:
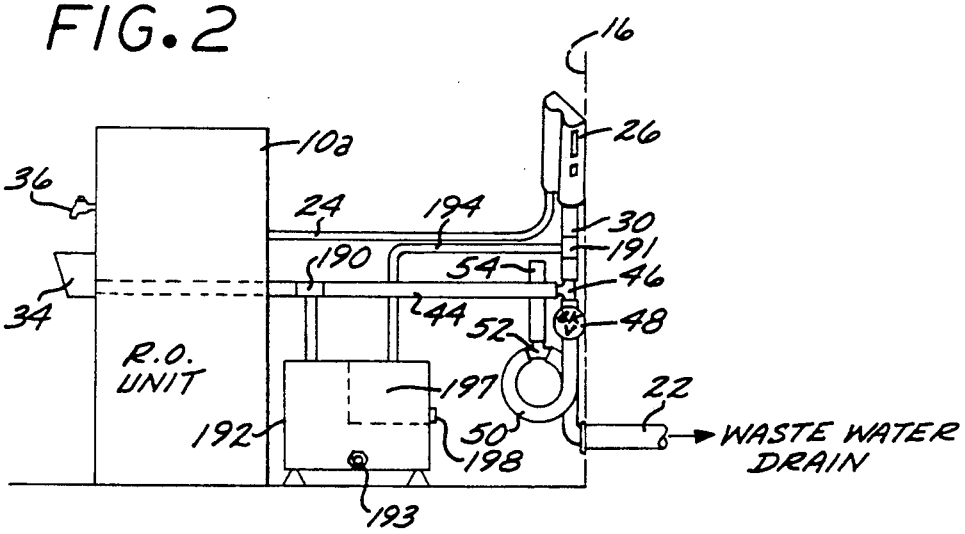
FIG. 2 is a schematic view of the air gap apparatus in a reverse osmosis water cooler system.

FIG. 2 illustrates an arrangement in which RO unit is a free standing water cooler similar in function to the RO unit 10 of FIG. 1. Where components of the respective arrangements are identical, the same reference numerals are used. Where the components are not identical but are similar in operation, the same reference numeral is used with a lower case letter. In FIG. 2 the lower case letter "a" is used, in FIG. 3 the letter "b" is used, and in the other figures a similar scheme is used to differentiate between the elements of the various embodiments which are described.

In the arrangement of FIG. 2, RO unit 10*a* includes the air gap inlet conduit 24 connected to the air gap apparatus 26 as before, but a spillage cup 34 is located beneath the faucet or spigot 36, emptying into a conduit 44. The conduit 44 is connected to a "T" fitting 46 having one of its legs coupled to the air gap outlet conduit 30. The other leg is coupled to a check valve or backflow restrictor 48 which leads to a trap 50 that empties into the waste water drain 22. The trap 50 includes a special "T" fitting 52 which vents to atmosphere through a vertically oriented vent tube or stand pipe 54.

If it is desired to collect the waste or "gray" water from the RO unit, a T-fitting 190 is placed in fluid communication with conduit 44 to tap off the waste water for collection in a holding tank 192. This water can be used for gardening or the like by connecting a garden hose (not shown) to a hose outlet 193 that is attached to the tank 192.

Once the tank 192 is full, any further waste water cannot flow into the tank, instead emptying through a T-connection 191 and a T-fitting 46 to the drain line. Although not illustrated, either or both of the fittings 190 and 191 can be provided with adjustable restrictors to shunt only a predetermined portion of the waste water into the T-fitting 46.

Alternatively, a tank 197 can be coupled to the T-fitting 191 by means of a the conduit 194. Any high velocity backflow not stopped by backflow restrictor 48, and not passing to atmosphere through the vent pipe 54, the passes through the conduit 194 into the tank 197. Water in the tank 197 can then flow into a conduit 198. Although not illustrated, the conduit 198 can be connected to the drain line 22.

The size and location of tanks 192 or 197, and the relative rates of flow into and out of the tanks, can be varied as required by the particular application.

Figure 3:
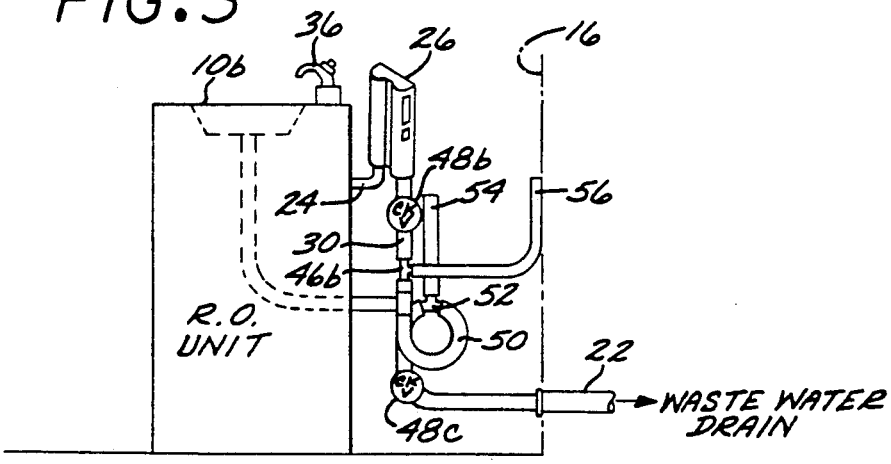
FIG. 3 is a schematic view similar to FIG. 2, but illustrating the air gap apparatus in combination with a top mounted RO water cooler having a different form of backflow restrictor, and with a venting connection.
Figure 4:
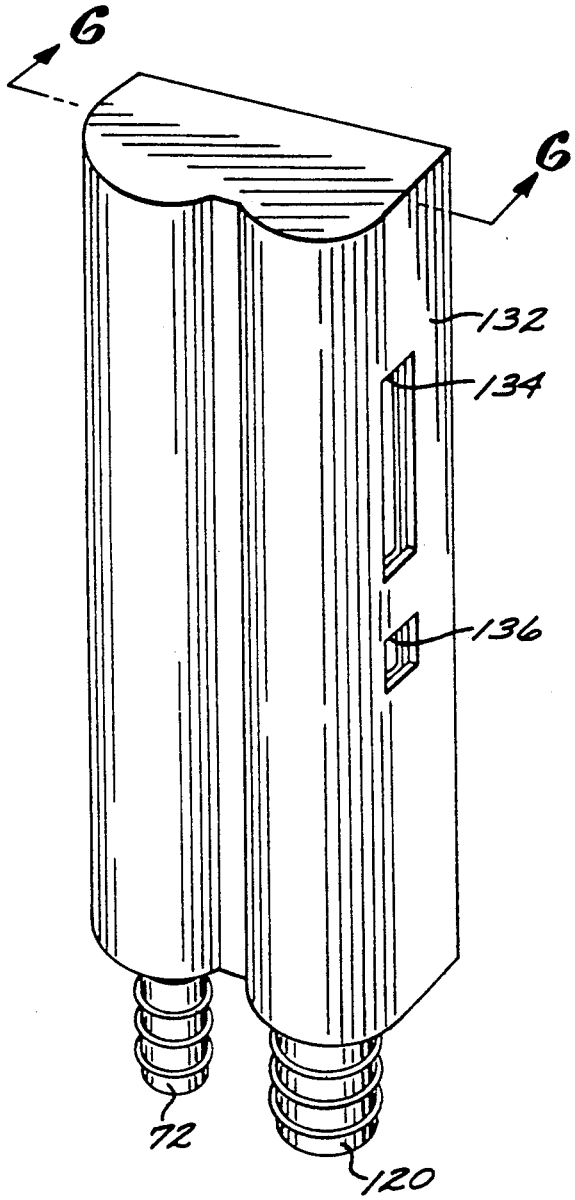
FIG. 4 is an enlarged front perspective view of the air gap apparatus of FIG. 1.
Figure 5:
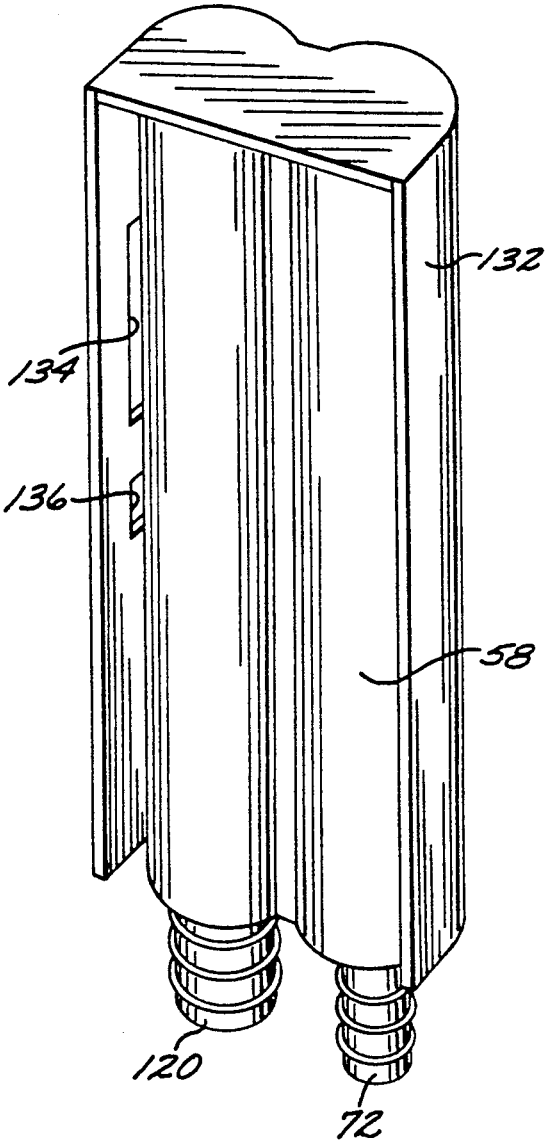
FIG. 5 is an enlarged rear perspective view of the air gap apparatus of FIG. 1.

FIG. 3 illustrates a free standing RO unit 10*b* having a discharge spigot 36 and a reject water air gap inlet conduit 24 which is coupled to the air gap apparatus 26.

The apparatus 26 includes an integral backflow restrictor 48*b* connected by the outlet conduit 30 to "T" fitting 46*b*.

A vent pipe 56 is connected to the fitting 46, and extends laterally and upwardly for mounting to the wall 16. The pipe 56 can be made free standing, or it can be mounted to either the inside or outside of the RO unit, as desired. The trap 50 is coupled to fitting 46*b* and, as in the arrangement of FIG. 2, vents through a stand pipe 54 and empties into drain line 22.

Use of vent pipe 56 and fitting 46*b* is optional, and their location and height can be changed. Also, fitting 46*b* can be located between the apparatus 26 and the backflow restrictor 48*b*. The upper ends of vent pipe 56 and stand pipe 54 are preferably located lower than the air gap openings in the apparatus 26.

The details of a double bore embodiment of the present air gap apparatus 26 are illustrated in FIGS. 4–9. Its components are preferably molded out of suitable light weight, high strength plastic material. The apparatus 26 comprises a vertically elongated housing 58 characterized by an outer wall 60 integral with a central wall 62. Together these define a pair of adjacent, open ended and generally cylindrical left and right bores or chambers 64 and 66, respectively.

The inner surfaces of the walls 60 and 62 at the base of the left chamber 64 include a reduced diameter portion defining a shoulder 68. The walls at the base of the right chamber 66 include a similar reduced diameter portion which define a shoulder 70 that forms a continuation of the shoulder 68.

The lower end of the left chamber 64 is closed by a cylindrical port or inlet fitting 72 having an annular flange which seats against the shoulder 68. The fitting 72 also has an annular groove which receives a sealing O-ring 74 to provide a watertight fit between the fitting 72 and the housing 58.

The inlet fitting 72 includes a depending tubular connector portion 76 which has a plurality of longitudinally spaced apart gripping ridges 78. The ridges can be V-shaped, as illustrated, but can also be made of rounded or square cross section, if desired. Forcible sleeving of the air gap inlet conduit 24 (see FIGS. 1–3) onto the connector portion 76 causes the ridges 78 to press into the flexible plastic material of the conduit. Since the waste water discharge from an RO system is at a relatively low pressure and rate of flow, the use of such ridges is more than adequate to establish a fluid tight fit, and at low cost.

The inlet fitting 72 also includes an integral, upwardly extending and generally cylindrical tie member 80 which extends to the top of the left chamber 64. The upper end is threaded for connection to a housing closure 82, as will be seen. Further, the diameter of the tie member 80 is less than the internal diameter of the left chamber 64 so that an annular passage 84 is defined.

The inlet fitting 72 includes a longitudinal inlet passage 86 which extends up into the lower portion of the tie member 80, at which point it becomes a lateral passage 88 which opens into the annular passage 84.

Figure 6:
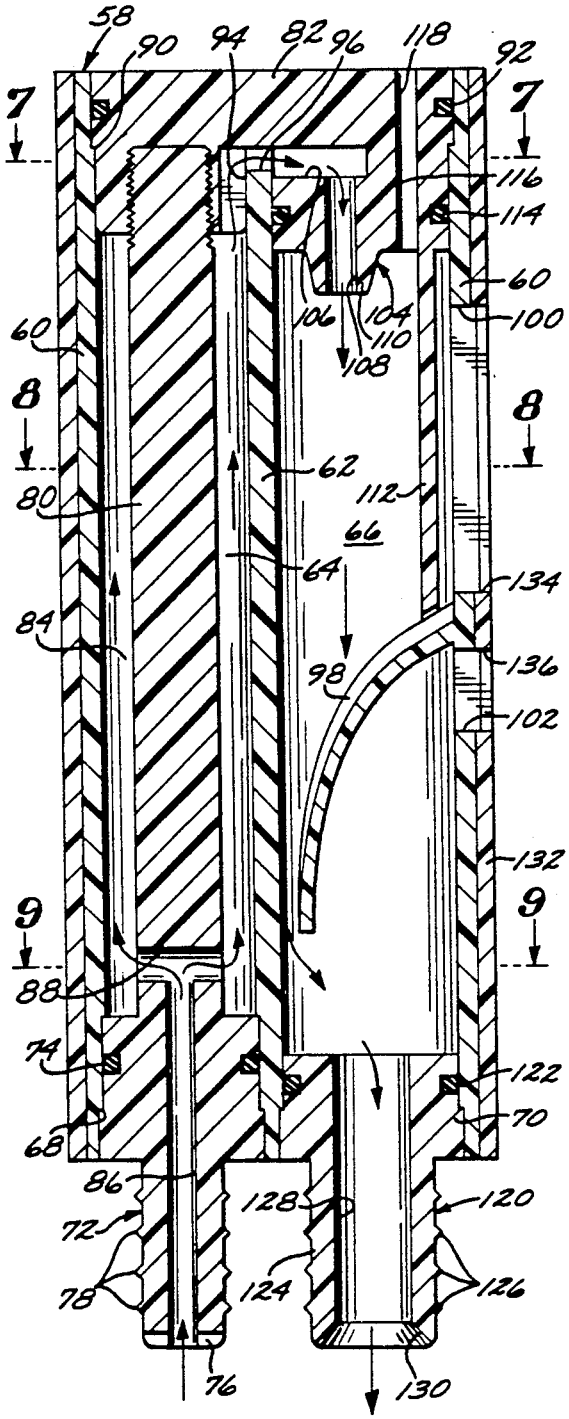
FIG. 6 is an enlarged longitudinal cross sectional view of the air gap apparatus.
Figure 7:
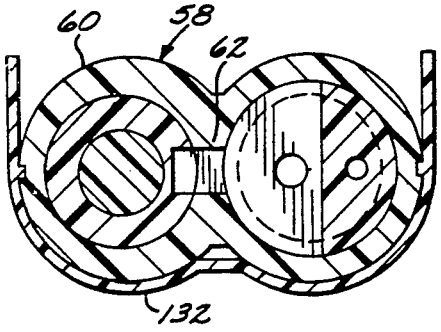
FIG. 7 is a view taken along the line 7—7 of FIG. 6.

The upper closure 82, as best seen in FIG. 6, is configured to fit within the upper ends of the cylindrical chambers 64 and 66. The inner walls of these upper ends include a continuous shoulder 90. A complemental flange of the closure 82 rest upon the shoulder 90 to locate the closure in position. A sealing element 92 fits within a peripheral groove in the closure 82 to provide a watertight connection.

The underside of the closure 82 adjacent the annular passage 84 includes an internally threaded boss to receive the upper threaded end of the tie member 80. The boss is also provided with a passage 94 which communicates with a lateral passage 96 located in the top of the housing inner wall 62. As will be seen, these passages provide a path for RO reject water to flow into the right chamber 66.

Figure 8:
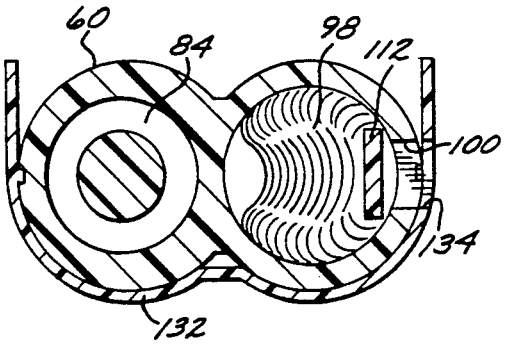
FIG. 8 is a view taken along the line 8—8 of FIG. 6.
Figure 9:
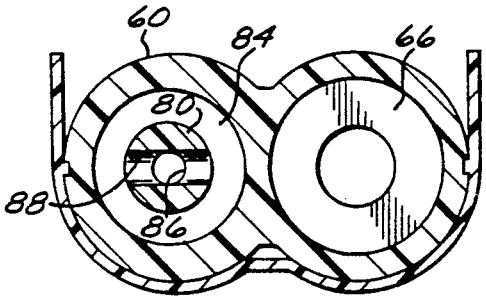
FIG. 9 is a view taken along the line 9—9 of FIG. 6.

The wall of the chamber 66 located to the right in FIG. 6 is molded to integrally include a deflector wall 98 which has two important functions. As best seen in FIGS. 6 and 8, the wall 98 extends inwardly and downwardly toward the inner wall 62. The lower extremity of the wall 98 terminates just above the bottom of the chamber 66, and it is also spaced from but is located closely adjacent the inner wall 62 to define an exit passage for the RO reject water. The upper surface of the deflector 98 from its root end to its tip end is made concave to receive the falling stream of water RO water and smoothly direct it downwardly out of the apparatus 26.

The chamber wall above the deflector wall 98 is provided with a vertical air gap opening 100 which is at least one inch high, as required by most plumbing codes. A similar but smaller overflow or backflow opening 102 is provided in the chamber wall below the deflector wall 98.

The size, number and configuration of the openings 100 and 102 can be varied as required, but the lower margin of the opening 102 should always be below the lower margin of the opening 100. The possible variations in the sizes and locations of the openings 100 and 102 will become more apparent later when the operation of the apparatus 26 is described.

The upper end of the right chamber 66 receives a generally cylindrical nozzle fitting 104 which is integral with the upper closure 82. The upper portion of the fitting 104 includes a horizontal passage 106 which receives waste from the horizontal passage 96 in the housing inner wall 62. Waste water in passage 96 can then flow downwardly through an elongated vertical nozzle passage 108 in the fitting 104 and in a depending nozzle portion 110 which forms the lower portion of the fitting 104. As will be seen, these passages are preferably sized and configured to achieve a relatively nonturbulent, high rate of water flow out of the nozzle passage 108.

The nozzle fitting 104 includes an integral, depending wall or splatter shield 112. The lower extremity of the splatter shield 112 either rests upon or is located just above the upper surface of the deflector wall 98. In addition, the wall 112 overlies but is spaced from the air gap 100. This allows air to pass freely through the air gap 100, around the wall 112 and into the interior of the right chamber 66, while yet preventing water from the nozzle portion 110 from splattering out of the air gap 100.

The nozzle fitting 104 further includes a peripheral groove which receives a sealing element or O-ring 114. This provides a sealing relationship with the housing 58. Fitting 104 also includes a longitudinal vent opening 116. This venting of the right chamber 66 adds to the venting through the air gap 100 and backflow opening 102. It provides yet further assurance that backflow and backsiphonage does not occur, even if all of the opening 102 and a substantial part of the lower portion of the opening 100 were to be submerged in polluted water.

The securement of the upper end of tie member 80 to the upper closure 82 firmly secures together housing 58, inlet fitting 72, and upper closure 82.

A generally cylindrical outlet fitting 120 is fitted into the open lower end of the right chamber 66. It includes a peripheral flange which complementally seats upon the chamber shoulder 70 to located the fitting 120 in position. A sealing member or O-ring 122 is received within a peripheral groove in the fitting 120 to provide a watertight seat with the housing 58. Fitting 120 may be secured in position by a suitable adhesive, ultrasonic welding, or by a set screw. However, use of the cam 140 of FIG. 11 is preferred because it enables easy disassembly for service or repair.

The fitting 120 includes a depending connector portion 124 having gripping ridges 126 like the ridges 78 of the inlet fitting 72. These enable a sealing connection with the resilient plastic material of the air gap outlet conduit 30 which is illustrated in FIGS. 1–3.

The fitting 120 also includes a longitudinal passage 128 communicating at its upper end with the right chamber 66 and at its lower end with a suitable concave check seat 130.

A vertically extending, generally U-shaped escutcheon 132 is slidably or snap fitted in any suitable manner over the housing 58. In the embodiment illustrated the sides of the escutcheon include longitudinally extending ridges which mate with complemental portions of the outer surfaces of the sides of the housing 58 to hold the escutcheon in place.

The escutcheon includes openings 134 and 136 aligned with the air gap 100 backflow opening 102, respectively, to enable fluid flow through the air gap and backflow opening.

Where it is desirable to mount the apparatus 26 to a wall or partition for ready inspection and maintenance, each of the inlet and outlet fittings 72 and 120 can be configured as a 90 degree elbow. The horizontal portions of the elbows would then project interiorly of the wall or partition for connection to the air gap inlet conduit 24 and the air gap outlet conduit 30, respectively.

In operation of the air gap apparatus, relatively slow flowing reject water from the RO system passes through the air gap inlet conduit 24, through the inlet passage 86 of the inlet fitting 72, through the lateral passage 88 in the tie member 80, and through the passages 94, 96, 106 and 108 into the right chamber 66.

The water stream from the nozzle portion 110 is smoothly channeled and directed by the deflector wall 98 toward the outlet fitting 120, and wall 112 prevents random droplets of water from splattering out of the air gap 100.

Several features of the present apparatus promote a nonturbulent, controlled flow of water at the nozzle passage 108. This is important to prevent splattering at the air gap 100 and also enable the relatively small water flow passages to handle a maximum rate of water flow.

Current RO systems have a "drip" rate of flow in the order of one-half gallon per minute, the water tending to drip or flow in droplets out of the nozzle passage 108. However, the present air gap apparatus is designed to operate within a flow range above one-half gallon per minute so that it can be used in conjunction with larger RO units, or with more than one RO unit. For example, as seen in FIG. 6, a second inlet fitting 87 from another RO unit (not shown) can be fitted to the apparatus so as to empty into the annular chamber 64.

It has been found that water flow through the chamber 64 and the passages 94, 96, 106 and 108, prior to discharge from the nozzle fitting 104, tends to become relatively turbulent as it is violently reoriented and swirled upon experiencing abrupt changes in direction of the water passages. The water flow also changes in velocity as it undergoes changes in passage size from the relatively small inlet passage 86 to the larger chamber 64, and then to the passage 108. These all promote a swirling, scattered or turbulent, nonlaminar flow of water at the passage 108.

Such turbulent flow causes scattering or splattering of the water as it leaves passage 108, increasing the undesirable possibility of uncontrolled splattering out of the air gap 100. In addition, it has been found that such inefficient, turbulent flow undesirably reduces the quantity of water that can flow through the passes 94, 96, 106 and 108. It also results in a scattered, uncontrolled dribble of water that cannot be effectively aimed or directed through the space between the inner surface of the inner wall 62 and the deflector wall 98. Proper aiming of a formed stream of water through the space has been found to increase the flow rate through the space without backing up toward the nozzle fitting 104 of relatively rapidly flowing RO waste water.

Providing a coherent or formed, generally nonturbulent stream of water is achieved in the present air gap apparatus by inserting in the annular chamber 64 a water flow stabilizing means such as granular material, plastic mesh material, or plastic screen material 113. Water can flow in a nonturbulent manner through the interstices of the material 113 and yet rise at a controlled rate in the chamber 64. If desired, similar material could also be provided in one or more of the other passages through which the RO waste water must flow before reaching the chamber 66. The material has an ancillary benefit in filtering out possible foreign matter that might clog the nozzle passage.

Nonturbulent flow is also promoted by using a particular sequence of passage sizes from the inlet 86 to the discharge end of the nozzle passage 108. The inlet passage 86 is typically rather small. The water passages through the chamber 64 are made larger to enable slowing of the water. The passages such as the passage 96 just upstream of the nozzle discharge are also made larger than the nozzle discharge passage for the same reason. The nozzle passage is made slightly larger than the inlet passage 86 so that it will pass and not be clogged by any foreign material that has entered through the inlet passage 86.

The relatively large capacity passages 64 and 96, compared to the passage 108, form a relatively quiescent zone, promoting a substantially uniform rate of flow just prior to the final nozzle passage 108. The resulting relatively nonturbulent, coherent shaped stream or pattern of steady droplets out of the nozzle fitting 104 flows smoothly toward the outlet fitting 120.

Smoother, more uniform water flow through the apparatus 26 is also promoted by providing a larger diameter entry or funnel portion 115 at the upstream ends of the nozzle passage 108 and the outlet passage 128. The funnel portions 115 provide a smoother transition for water flowing through the associated downstream passages.

The foregoing structural features have been found to substantially double the volume of water flow through the air gap apparatus, i.e. from one-half gallon per minute to over one gallon per minute.

Assuming a condition of backflow because of a blockage in the drainage system which is coupled to the outlet fitting 120, the backflow water either rises slowly and passes out of backflow opening 102 or, if the backflow pressure differential is sufficiently great, the backflow water flows upwardly through the fitting 120 in the form of a forcible jet. In prior art air gap apparatus, such a jet could very well bridge the air gap 100, impinge against the nozzle fitting 104, and contaminate the potable water of the RO system. However, in the present apparatus 26 such a jet is intercepted by the deflector wall 98 and is shunted out of the apparatus through the backflow opening 102.

In the event of backsiphonage, the same shunting action occurs, without affecting the breaking of the siphon by venting through the air gap 100, the backflow opening 102, and the vent opening 116. Apparatus 26 thus prevents contamination of the potable water of the RO system under both slow and rapid reverse flows.

The showing of an air gap 100, backflow opening 102 and deflector wall is merely exemplary and many variations are possible. Thus, one continuous longitudinal air gap opening could be provided (not shown) with a laterally and downwardly directed wall between them to define what might be termed an air gap zone or chamber above the wall and opening to the atmosphere, and a backflow zone or chamber below the wall and also opening outwardly to the exterior of the apparatus 26.

The important elements of any such embodiment include a partially laterally and downwardly directed deflector wall disposed across a compartment. The deflector wall together with the walls of the compartment define what might be termed an air gap zone or chamber into which a nozzle directs RO waste water, and also define a backflow zone or chamber in communication with a drain line.

The air gap chamber vents to atmosphere through one or more air gap openings, and the backflow chamber opens to the outside by means of one or more backflow openings. The lower margin of the lowest of the backflow openings is below the lowest margin of the lowest one of the air gap openings.

The deflector wall must be oriented to direct the downflowing RO waste water through an exit passage out of vertical alignment with the drain opening, and also oriented to direct backflowing waste water out of the backflow opening, particularly high velocity, "explosive" type backflows. Lower velocity backflows caused by a drain blockage that prevents drainage of the RO water, in contrast, simply rise above the threshold of the lower margin of the backflow opening and drain outwardly of the air gap apparatus. This arrangement allows normal, forward flow of waste water while substantially preventing sudden, high velocity backflows.

The location, number and arrangement of the air gap and backflow openings and the deflector wall can be changed so long as the foregoing characteristics are preserved.

FIGS. 10 and 11 illustrate a form of air gap apparatus substantially identical to the air gap apparatus 26, differing primarily in the interconnection of the components. Identical parts are assigned identical numerals, while similar parts are assigned identical numerals with the subscript "b".

The upper closure **82*b* includes an integral, downwardly extending tie member 80*b* having a threaded end. The inlet fitting 72*b* includes a complemental threaded opening into which the end of the tie member 80*b* is threaded but, instead of a lateral passage through the tie member to provide communication with the left chamber 64, a V-shape passage 88*b* is used. Another difference is the existence of an annular groove 138 in the inlet fitting 72*b* to receive a radially outwardly extending lobe or locking portion 140 integral with the outlet fitting 120*b***.

Fitting **120*b* is rotatable to move the locking portion 140 between the locked position illustrated, and an unlocked position in which the fitting 120*b* can be withdrawn from the housing 58 by pulling it outwardly against the bias of the O-ring 122. In its locked position the fitting 120*b* cannot be withdrawn because of the interconnection between the inlet fitting 72*b* and the upper closure 82*b***.

The arrangement provides a positive retention of outlet fitting **120*b*, as compared to the arrangement of FIGS. 4–9**.

Referring now to FIGS. 12 and 13, a check valve or backflow restrictor 142 is illustrated which can be attached to the outlet fitting 120 of FIGS. 6–9. Used alone the backflow restrictor would not comply with most plumbing codes because if it failed pollution of the RO system could occur. However, its use is believed to be acceptable as long as the air gap 100 is used. The air gap satisfies such codes in that it provides protection against high velocity or sudden backflows from the drainage lines.

Although the restrictor 142 preferably includes a buoyant, perfectly round ball to close off all backflow when seated upon the seat 130, in the outlet fitting 120 a roughened ball 144 is used to provide imperfect seating. It is held in position against downstream flow by a circular, centrally bored retainer 146. The roughened character of the ball 144 substantially stops all sudden, high velocity backflow. Any small backflow will escape through the backflow opening 102. The advantage of the imperfect seating is that it will always allow the usual slow rate of flow of RO water downstream even if the ball 144 is jammed in its seated position.

Figure 37:
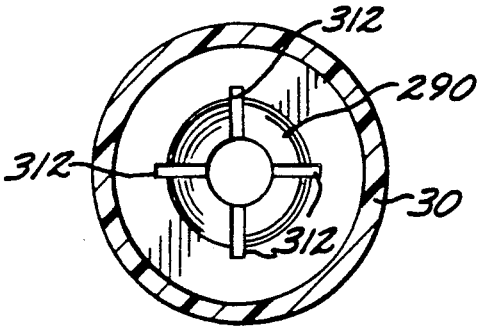
FIG. 37 is a view taken along the line 37—37 of FIG. 30.

Another version of backflow restrictor is described in connection with FIGS. 30 and 37, as will be seen.

The retainer 146 includes the same gripping ridges 126 as the outlet fitting 120 so that it becomes a push-in restrictor which can easily be fitted within the open end of the conduit 30 before the conduit 30 is forced onto the fitting 120. The retainer 146 includes four radially extending, circumferentially spaced apart ribs or seats 148 upon which the ball 144 rests during normal water flow downstream past the ball. Such downstream flow takes place through the retainer 146 by passing between the seats 148.

As best seen in FIG. 13, two of the seats 148 include slots 150 into which a screwdriver can be inserted to facilitate rotation and forcible insertion of the retainer 146 into the conduit 30. Similar screwdriver slots are provided in the opposite end of the retainer 146 so that the retainer can be inserted from either direction.

The specific gravity of the ball 144 can be chosen so that it will be heavy enough to normally rest upon the seats 148 and thereby insure passage of even the slowest flowing reject water. The heavy ball would allow slowly rising backflow water to move upwardly toward the backflow opening 102. Alternatively, the ball 144 can be made of buoyant material so that it will float upon slowly rising backflow water and engage the seat 130 to stop such backflow. However, the buoyant ball will react to a significant downstream flow of reject water to move off its seat 130 and allow such flow. As previously indicated, the ball 144 can be made smooth, or roughened, grooved, or its seat similarly configured, depending upon whether a small backflow of waste water is to be permitted.

The foregoing components can be combined in a variety of ways, depending upon the particular application. The embodiments of FIGS. 1–3 are merely exemplary of various combinations.

More particularly, in the operation of the RO system of FIG. 1, reject water from RO unit 10 flows through air gap inlet conduit 24 to air gap apparatus 26. As seen in FIG. 6, the water path is through the left chamber 64 and into the nozzle fitting 104. The air gap provided in the right chamber 66 prevents backsiphoning of the reject water and its possible contact with fitting 104. The deflector wall 98 prevents high velocity backflow from bridging the air gap and coming into contact with fitting 104. Instead, wall 98 directs any such high velocity backflow out of the opening 102. In addition, backflow restrictor 142 in the air gap outlet conduit 30 provides further assurance against both slowly rising or high velocity backflow.

In the arrangement of FIG. 2, operation of the air gap apparatus 26 is similar to that of FIG. 1. However, there is no "P" trap 20. Consequently trap 50 and its venting coupling are utilized, preferably in conjunction with a backflow restrictor 48 like the backflow restrictor 142 of FIG. 12, and similarly inserted into the associated conduit.

The system of FIG. 3 comprises an RO cooler **10*b* having vent pipes 54 and 56, trap 50, and a pair of backflow restrictors 48*b* and 48*c*. The conduit 24** extends through and rests upon the margins of an opening provided in the back wall of the cooler. The drain cup for the system is located in the top of the cooler.

Similar to the backflow restrictor of a previous embodiment, the backflow restrictor **48*c* provides an added level of protection against high velocity backflow which might contaminate the system, particularly in the vicinity of the air gap 100. Contamination is most unlikely to occur because any backflow would have to pass through backflow restrictor 48*c*, in which case it would probably flow out of the standpipe 54. Even if such a backflow tended to flow toward the backflow restrictor 48*b*, it would preferentially flow out of the vent pipe 56. In the unlikely event that the backflow passed through the backflow restrictor 48*b* and into chamber 66, it would flow out of opening 102 before it contaminated the air gap 100**. The backflow restrictors are particularly effective against violent backflows. Even though characterized by no resistance to downstream flows of RO waste water, as previously explained, such restrictors quickly seat and obstruct violent, high rate reverse flows.

In each of the foregoing systems the present air gap apparatus provides a usual air gap function but, unlike prior art air gap devices, also provides additional levels of protection against system contamination through either slow rising of high velocity backflow. The backflow is instead diverted externally before it is able to contaminate the potable water system upstream of the air gap 100.

The air gap apparatus is sufficiently compact that it can be easily packaged in kit form for original or after market installation in an RO system. Such a kit would preferably incorporate one or more of the backflow restrictors and traps disclosed for the added protections they provide.

Referring now to FIG. 14, an RO system 10*c* is illustrated which is disposed within an enclosure 200 resting upon the counter 14. Such a countertop system is a popular alternative to the relatively expensive and more difficult to install under-the-counter systems of FIG. 1.

Water is supplied to the system 10*c* through a conduit (not shown) which is connected to the sink spout 202. The RO waste water or effluent is discharged through another conduit (not shown) which empties into the kitchen sink 12.

In the prior art countertop units these supply and waste conduits were combined in an unsightly umbilical bundle extending across the countertop between the unit and the sink. The arrangement prevented normal use of the spout 202 because the RO water system supply hose was attached to it. Also, the constant flow of waste water into the sink was annoyingly evident to the user. In contrast, the present air gap apparatus can be incorporated within the countertop RO systems in a way that eliminates these shortcomings.

In the unit 10*c* the usual pressurized potable water storage tank and RO generating unit (not shown) are fitted within the enclosure 200. Water from the storage tank is drawn off by the spout 202. The spout 202 overlies a drip or spillage tray 201.

Water is supplied by a conduit 208 connected to the same supply line that supplies cold water for the kitchen sink faucet.

Although not shown, the enclosure 200 typically has controls or system display lights and indicators to apprise the user of the operational status of the system.

In that regard, throughout the drawings diagrammatic showings are included to denote the possible location of such controls and indicators and the cables and the conduits associated with them. This is seen at 205 in FIGS. 15 and 16, and at 207 in FIG. 18 for example.

FIGS. 15–18 further illustrate the air gap apparatus 26*c* as contained within a cylindrical body 204 located within RO enclosure 200. However, the cap 206 of FIG. 15 is omitted in the arrangement of FIG. 14.

The body 204 seen in FIGS. 15–17 is analogous to the fixture illustrated in my U.S. Pat. No. 4,771,485, issued Sep. 20, 1988 for "Faucet Fixture". It enables the RO system supply water conduit and the air gap outlet conduit to be disposed through the counter top, eliminating the unsightly umbilical arrangement of the prior art.

As best seen in FIG. 17, body 204 includes a flange 210 resting upon the kitchen counter 14 above a hole in the counter. A threaded, hollow stud 212 extends through the hole from the lower portion of the body 204, and a wing nut 214 is threaded onto the stud into engagement with the underside of the counter to secure the body in position. A plastic sleeve 216 fitted over the stud 212 protects its threads.

The body 204 includes a pair of vertical walls 220 which extend radially inwardly from one side of its cylindrical interior 218, as best seen in FIG. 18. Oppositely of the walls 220, the interior 218 includes vertically oriented receptacle slides 224. These receive a complemental projection 224 integral with an air gap housing 226 to fit the housing 226 into place upon the inner edges of the walls 220.

The air gap housing 226 includes a vertically elongated air gap 100*c* and a backflow opening 102*c*, both of which function like the corresponding elements 100 and 102 of the air gap apparatus 26 of the first embodiment. In addition, the cylindrical body 204 includes adjacent openings 134*c* and 136*c* aligned with the air gap 100*c* and the backflow opening 102*c*.

In the air gap apparatus 26 of FIG. 6, a wall or splatter shield 112 extended over the adjacent air gap 100 and a deflector wall 98 extended over the backflow opening 102. This routed any backflow from the drain or waste lines out through the backflow opening 102.

In the arrangement of FIG. 17, a combination of the splatter shield 112 and deflector wall 98 are provided in the form of an arcuate, downwardly and inwardly directed splatter shield, director wall or element 228. The element 228 includes an upper portion to prevent gravity flowing RO waste water from splattering out of the air gap 102*c*. In addition, a lower portion forms a smooth continuation of the upper portion, overlies the backflow opening 102*c* and terminates adjacent the lower or discharge end of the air gap housing 226 radially inwardly of the centerline of the discharge end.

The element 228 includes an integral horizontal director wall 230 in engagement with the inside of the body 204 between the air gap 100*c* and the backflow opening 102*c*. The undersurface of wall 230 forms a smooth continuation of the lower portion of element 228 so that backflowing water is smoothly directed out of backflow opening 102*c*.

The inner surface of the curved element 228 is arcuate, as seen in FIG. 18, to smoothly direct downwardly flowing RO waste water toward the discharge end of the body 204.

The lower extremity of body 204 includes several structural details to enable it to be "universally" connected to a number of supports and conduits, as will be seen. Thus, it includes a plurality of longitudinally spaced gripper ribs 232 of square cross section for sealing engagement with the inner surface of a relatively large diameter conduit (not shown). Below that it includes external threads 234, as seen in FIG. 17 and particularly in FIG. 21, and at its lower end includes a plurality of gripper ribs 126*c* like those seen in FIG. 6, but located as indicated at 236 in FIG. 21. The ribs 236 engage the air gap outlet conduit 30 that extends through the threaded stud 212.

The upper end of the cylindrical interior 237 of the air gap housing 226 is closed by an upper closure 82*c*. The closure 82*c* includes a tubular boss 238 which extends into the upper end of the housing 226, and a tubular boss 240 which extends into the upper end of the sector 237. The boss 240 includes gripping ridges (not shown) which fix the boss 240 in sealing relation with the upper end of the air gap inlet conduit 24.

The closure 82*c* further includes a cap portion 242 extending between the bosses 238 and 240 and having a passage 244 which provides fluid communication between the bosses. Cap portion 242 includes a downwardly extending tube or nozzle 246 which closely fits within the boss 238. Also, in the embodiment of FIG. 17, a cap 248 is fitted over and closes the upper end of the body 204.

The nozzle 246 is located out of alignment with the lower termination of the director element 228 to insure that the nozzle 246 is out of the direct path of rapidly flowing backflow water. Another means to place the nozzle 246 out of the direct path of backflow water is illustrated in FIG. 20. The modified housing 226*d* which is illustrated has an inner wall which includes an inner bulge or protuberance 253 above its the lower end, and an undercut annular portion below the protuberance 253. This portion closely receives a ring 254 configured to form a streamline downward continuation of the protuberance 253. This causes backflowing waste water to be directed away from the directing element 228 and toward the backflow opening 102*c*.

Figure 34:
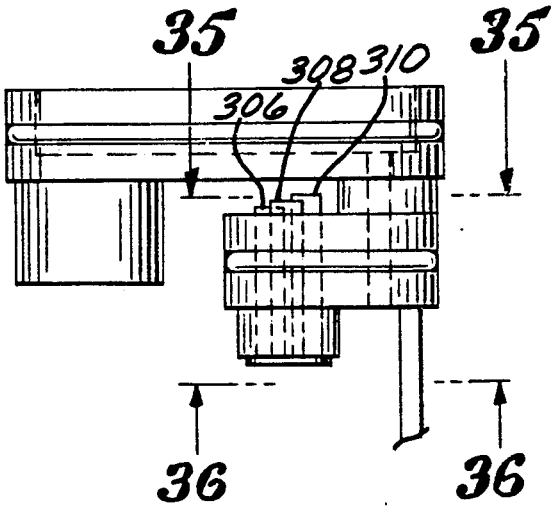
FIG. 34 is a partial front elevational view of a modified nozzle fitting which is interchangeable with the nozzle fitting of FIGS. 6 and 10.
Figure 35:
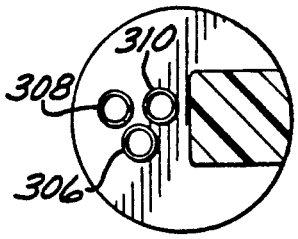
FIG. 35 is a view taken along the line 35—35 of FIG. 34.
Figure 36:
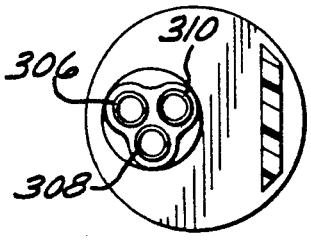
FIG. 36 is a view taken along the line 36—36 of FIG. 34.

FIGS. 34–36 illustrate how the nozzle 246 can be modified to become a plurality of nozzles 306, 308 and 310. The upper end of nozzle 306 is lowest, nozzle 308 is next highest, and nozzle 310 is highest. With this arrangement, any relatively high flow of RO waste water coming out of nozzle 246 of FIG. 17 is converted to smaller streams less likely to diverge and splatter out of the air gap 100*c*. It has been found that nozzle 306 can direct low flow waste water in a steady stream without scattering. The higher flow that might be scattered if it were all directed out of the nozzle 306 is instead successively converted by nozzles 308 and 310 into smaller, more coherent streams. At the highest rates of flow, the discharge would be out of all three nozzles. Obviously, this nozzle arrangement could be employed in any of the air gap embodiments herein described.

In the embodiment of FIG. 14, the cap 248, the upper closure 82*c* and the cap portion 242 shown in FIG. 17 are omitted, and the air gap inlet conduit 24 from the RO unit within the enclosure 200 extends directly through the open upper end of the body 204 into the upper end of the air gap housing 226. Also, mesh or like material 113 can be used in the passages upstream of the nozzle 246 to reduce flow turbulence, as previously discussed. Other flow enhancing features described in connection with previous embodiments can also be used if desired.

The components of the body 204 can be secured together in any suitable fashion, either temporarily by a press fit, or permanently through the use of adhesives or the like.

From the foregoing it will be evident that the embodiment of FIG. 14 enables use of countertop RO units without having water and waste conduits cluttering the counter surface.

With respect to the air gap apparatus of FIG. 17, it is particularly useful with an under-the-counter RO unit which has a separate faucet or spigot (not shown). The air gap apparatus can be made small and unobtrusive compared to the prior art combination spigot and air gap arrangements. Being separate from the spigot, the body 204 and the housing 226 have ample room to receive the air gap apparatus and also all of the electrical connectors and other conduits desirable for special applications. In particular, FIG. 15 illustrates how the threaded stud 212 can easily accommodate many electrical and fluid conduits.

FIG. 16 illustrates a wall mount arrangement similar to the countertop embodiment of FIG. 14. However, body 204*d* is configured to fit tightly against the wall, and the spigot 36*d* is side mounted. The conduits extend through a wire mold 250, and up into the base of the body 204*d*. A conduit or cable clamp 252 attaches the wire mold 250 to the adjacent wall.

FIG. 19 illustrates a simplified form of air gap apparatus for an under counter installation. It uses only the air gap portions of the body 14 illustrated in FIG. 17.

Thus, the air gap housing 226 and upper closure 82*c* are attached to the wall 16 beneath the kitchen counter 14 by a cable clamp 252*d*. The air gap inlet conduit 24 is fitted to the boss 206 of the closure 82*c*, and the air gap outlet conduit 30 is coupled to an end fitting 256. A flange on the fitting 256 is engaged by a nut 258, and the nut 258 is threaded onto threads 234 at the lower end of the air gap housing 226 to attach the conduit 30 in fluid tight relation to the housing 226.

Figure 21:
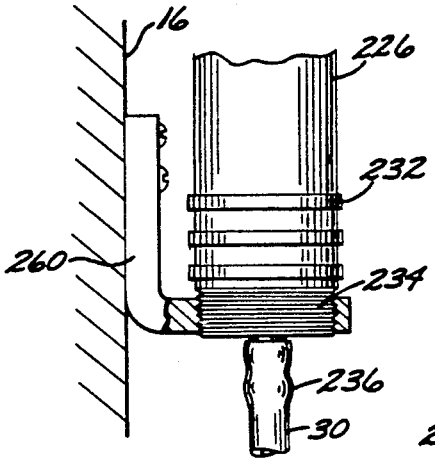
FIG. 21 is a side elevational view of the air gap housing of FIG. 19, except that it is illustrated as attached to a wall by threading the lower end of the housing through a wall bracket.

FIG. 21 illustrates another means for mounting the air gap housing 226 to a wall 16. In this embodiment the threads 234 on the housing fit into a threaded opening in the horizontal leg of a right angle bracket 260. The vertical leg of the bracket is screwed to the wall.

Figure 22:
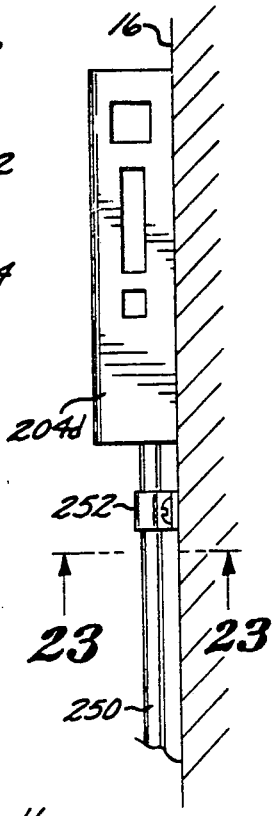
FIG. 22 is a side elevational view of the air gap housing which in FIG. 14 is illustrated as located in one form of body, but which is here illustrated as located within a decorative body attached to the wall.
Figure 26:
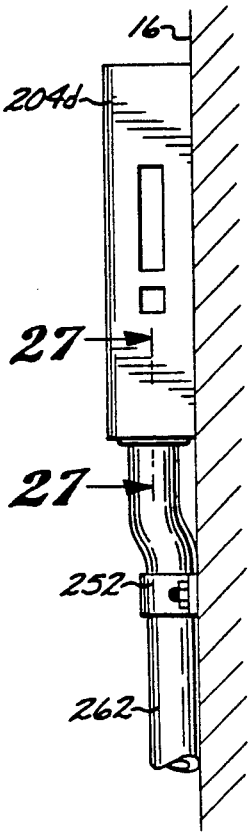
FIG. 26 is an arrangement like that of FIG. 22 except that the housing is coupled to a larger diameter waste water conduit.
Figure 23:
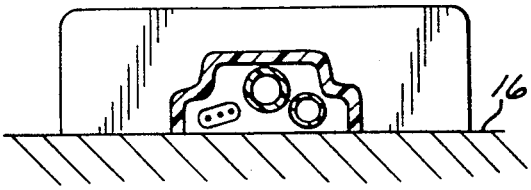
FIG. 23 is an enlarged view taken along the line 23—23 of FIG. 22, and also showing a protective sheath or cover placed in overlying relation to the conduits entering and leaving the air gap housing.
Figure 27:
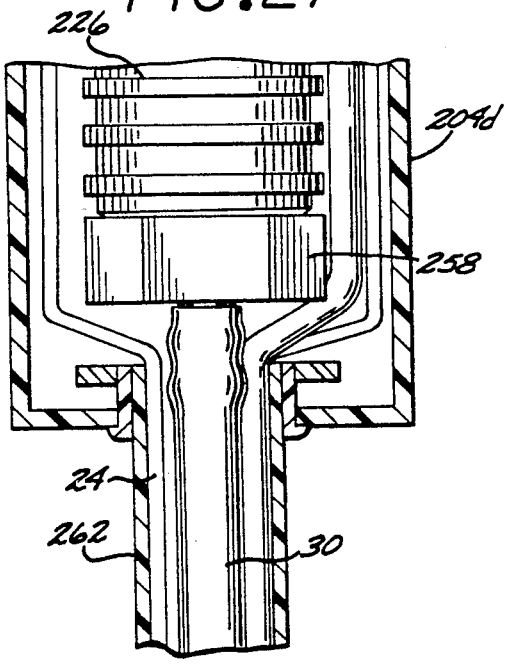
FIG. 27 is an enlarged view taken along the line 27—27 of FIG. 26.
Figure 31:
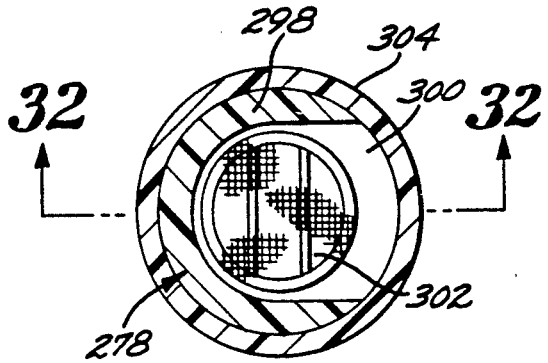
FIG. 31 is a view taken along the line 31—31 of FIG. 30.
Figure 32:
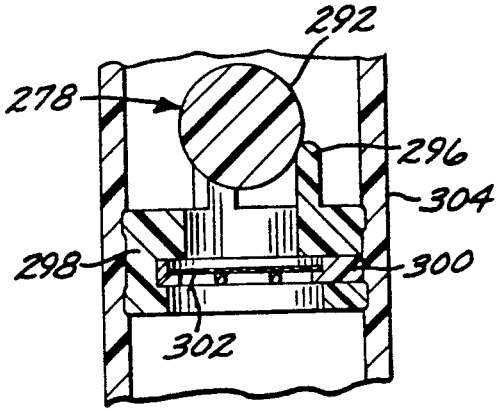
FIG. 32 is a view taken along the line 32—32 of FIG. 31.

FIGS. 22–27 illustrate yet other means for mounting the air gap housing 226 to a wall. As seen in FIGS. 22 and 27, the apparatus is located within a decorative case 204*d*. The wire mold 250 which carries the conduits 24 and 30 seen in FIG. 22 is attached to the wall in the same manner as in the embodiment of FIG. 16.

FIG. 26 is similar to FIG. 22 except that a relatively large protective conduit 262 attached to the lower end of the case 204*d* receives the conduits 24 and 30. The conduit 30 is attached to the housing 226 in a manner similar to that shown in FIG. 19.

Figure 24:
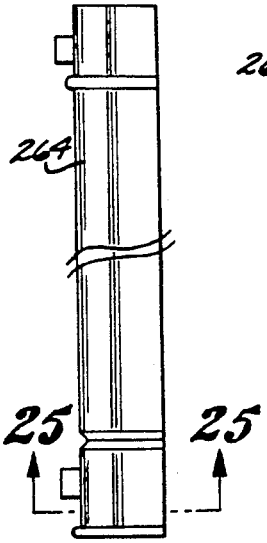
FIG. 24 is a side elevational view of a wire mold fitting adapted for placement between a decorative outer cover or jacket and the conduits connected to the air gap housing in a wall mount arrangement.
Figure 25:
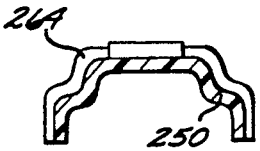
FIG. 25 is an enlarged view taken along line 25—25 of FIG. 24, and particularly illustrating the inner wire mold fitting and the overlying decorative outer cover.

The wire mold 250 of FIG. 22 is well known for attaching electrical conduit to a wall. It comprises a U-shape section which is snap fitted over one or more clips attached to the wall. As best seen in FIGS. 24 and 25, the wire mold itself can be concealed by a decorative cover 264 snap fitted in position.

Although not shown, the conduits passing from the lower end of the wire mold 250 to the under counter RO unit preferably pass through a grommet (not shown) that is fitted within an opening cut in the kitchen counter.

FIG. 28 is illustrative of how the air gap housing 226 can be fitted into a conduit wherever needed by simply cutting the conduit to provide adjacent sections 266. The lower end of the housing 226 is fitted into one of the sections, with the ribs 232 providing a fluid tight connection. Similar ribs 232 at the other end of the housing 226 enable a similar fluid tight connection with the other conduit section.

The gripper ridges 236 at the lower end of the housing 226 provide a fluid tight connection with the conduit 30, which is disposed inside the conduit section 266, and a similar fluid tight connection is provided at the upper end of the housing 226 by similar gripper ridges 236. These are formed on the upper portion of a modified nozzle 246*e*. The lower portion of the nozzle 246*e* is fitted within the upper end of the housing 226, and an intermediate or flange section 268 rests upon the upper end of the housing.

Figure 38:
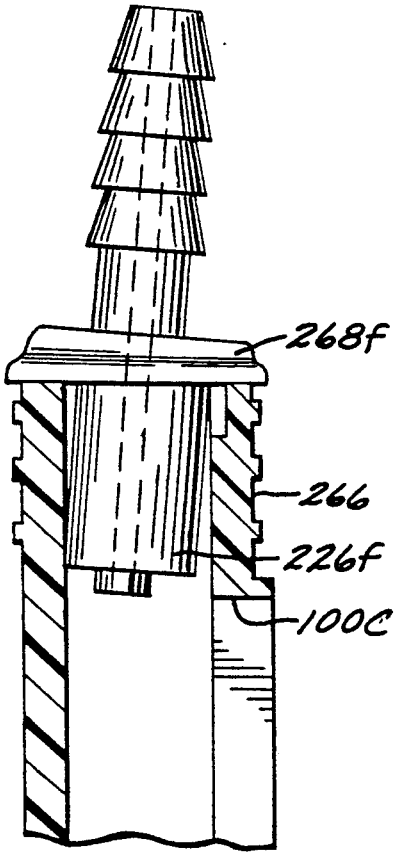
FIG. 38 is a front elevational view of a nozzle similar to that illustrated in FIG. 28, except that it is directed at an angle to the air gap centerline.

FIG. 38 illustrates a form of air gap housing 226 which is virtually identical to that seen in FIG. 28. However, the juncture between the flange section 268*f* and the body of the housing 226*f* is angled to cause waste RO water flowing from the nozzle to be directed at an angle away from the air gap 100*c*. This further reduces any possibility for splattering of the water out of the air gap. The angularly directed nozzle also directs the waste water stream into the passage or space between the wall of the housing 226, as seen in FIG. 28, and the lower end of the director element 228. This enhances the water flow rate through this space.

FIG. 29 illustrates a modified form of flow director device. The device comprises a splatter shield 270 which extends downwardly and inwardly to overlie the air gap 100*c*, and a deflector wall 272 which extends downwardly and inwardly from just above the backflow opening 102*c*. The wall 272 is integral with a circular flange which seats upon an annular ledge formed in the interior wall of the housing 226. A flexible bag-like backflow preventer 274 is seated upon the flange and is open at its upper end to receive and direct RO waste water downwardly. The lower end of the preventer 274 extends past the deflector wall 272 into the reduced diameter area adjacent the director ring 254*e*.

The lower end of the preventer 274 includes a small opening or slit which is normally collapsed to prevent backflow of waste water through it. However, the preventer material is sufficiently flimsy and flexible to allow forwardly flowing RO waste water to open the slit and pass toward the drain. The arrangement is et another means to prevent waste water backflow.

Figure 33:
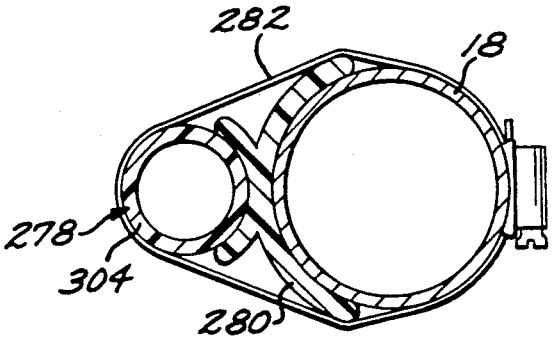
FIG. 33 is a view taken along the line 33—33 of FIG. 14.

FIGS. 30–33 illustrate yet another means to prevent waste water backflow. A "universal" type of ball backflow restrictor 278 is inserted in the drain conduit lines at any point downstream of the air gap housing 226. For example, in the embodiment of FIG. 14, the backflow restrictor 278 is located in the air gap outlet conduit 30 by first making a cut in the conduit 30. The opposite ends of the restrictor 278 are then inserted into the cut ends. As seen in FIG. 33, the restrictor 278 is next fitted into an arcuate recess in a holder 280. The larger diameter drain conduit 18 is fitted within an opposite, larger recess in the holder 280, and a pair of clamps or ties 282 securely hold together the conduit 30, holder 278 and drain conduit 18.

The restrictor 278 comprises identical upper and lower bodies 284 and 286 having gripper ridges 288. Forcibly fitting the cut ends of the plastic conduit 30 onto the ridges 288 provides a fluid tight connection.

Both bodies 284 and 286 include a ball seat 290 but only one is utilized, the parts being made identical for convenience. The seat 290 of the upper body 284 receives a ball 292 to stop high rates of back flow moving toward the air gap apparatus 26. As seen in FIG. 37, the seat 290 includes a plurality of radially directed ridges or ribs 312. Similar to the flow restrictors previously described, the ball 292 incompletely seals off the RO waste water forward flow path. Even if the ball becomes adhered or stuck to the seat 290 by greasy, sticky foreign waste from the drain lines, RO waste water can always flow past the restrictor 278. However, the restrictor 278 seats sufficiently to block sudden, high velocity backflows. Use of the ribs 312 thus serves a purpose similar to what would be accomplished by the use of the rough or irregular ball previously discussed, which was incapable of fluid tight seating upon the seat 290.

The ball 292 normally rests upon and is centrally supported by three upwardly projecting supports 296 integral with a cylindrical base 298. The base 298 is horizontally slotted to slidably receive a filter or screen holder 300 which supports a screen 302. The screen 302 prevents the passage of large size particles or chunks of foreign matter in the drain lines from backflowing past the backflow restrictor 278 into the air gap apparatus 26.

The base 298, including the inserted holder 300 and screen 302, are forcibly pressed within a length of plastic conduit 304, the resilience of the conduit 304 being sufficient to maintain the backflow restrictor 278 in position. In particular, the diameter of the conduit 304 approximates that of the conduit 30 so that the opposite ends of the conduit 304 are easily fitted over the gripper ridges 288 of the bodies 284 and 286. This is similar to the connection between the bodies 284 and 286 and the cut ends of the conduit 30.

FIGS. 33 illustrates the shape of the holder 280, including the configurations of its opposite recesses to receive the backflow restrictor 278 and the drain conduit 18.

The ball type backflow restrictor 278 is quickly and easily insertable within conduits downstream of the air gap apparatus to provide a function similar to that described in connection with the embodiment of FIG. 12. It prevents high rates of backflow of waste water by partial seating of the ball 292 immediately upon development of a pressure differential across the seat 290.

From the foregoing it will be seen that the present air gap apparatus includes several structural modifications that greatly improve its operation in the handling of typically low flow rate RO waste water. The small quantity of substantially constantly flowing waste water must be directed past the air gap opening so that it does not dribble or splatter out of the opening. Consequently, a small diameter nozzle is dictated to shape the stream. In contrast, a relatively large nozzle would simply result in random stream flow or dripping from a side of the nozzle passage.

Also, heretofore the passages leading up to the nozzle were of the same diameter or size, or even smaller, compared to that of the passage in the nozzle. Such passages were also characterized by sharp turns and changes in size so that a swirling or turbulence was imparted to the water steam. This in turn adversely affected efficient water flow through the passages, and also resulted in a turbulent, poorly shaped, noncoherent water flow from the nozzle.

As previously explained, the present invention provides highly efficient water flow, and a coherent nozzle discharge stream, by utilizing one or more structural modifications, including selective sizing of the passages, use of mesh or similar turbulence prevention means, multiple nozzles, use of smooth or funnel transition passages, alignment of the nozzle away from the air gap.

An important feature has been described which substantially prevents contamination of an RO unit by either slowly backflowing or explosively rapid backflowing waste water. Various combinations and arrangements of air gap and backflow openings have been described for preventing this.

Finally, various connection arrangements and backflow restrictors have been disclosed which further enhance the operation of the present apparatus.

While several forms of the invention have been illustrated and described, it will be apparent that various modifications can be made without departing from the spirit and scope of the invention.

What is claimed is:

1. Air gap apparatus for connection between a waste water inlet passage and a waste water outlet passage which is connected to a drain line, the apparatus comprising:

housing means defining an internal space;

deflector means supported in the internal space the housing means, the deflector means and the housing means defining an air gap chamber on one side of the deflector means and a backflow chamber on the other side of the deflector means;

nozzle means carried by the housing means for directing a flow of water from the inlet passage into the air gap chamber;

the housing means including an air gap in communication with the air gap chamber to vent the air gap chamber to atmosphere and thereby prevent back siphonage of waste water into the air gap chamber from the water outlet passage, the housing means further including a backflow opening in communication with the backflow chamber; and the deflector means being positioned to direct water coming out of the nozzle means toward the water outlet passage, and also to intercept and direct toward the backflow opening any backflowing water coming from the outlet passage.

2. Air gap apparatus according to claim 1 and including a splatter shield spaced from but substantially overlying the air gap to substantially prevent water from the nozzle means from splattering out of the air gap.

3. Air gap apparatus according to claim 1 wherein the deflector means extends inwardly and downwardly from the upper terminus of the air gap to a point below the backflow opening to reduce water splattering out of the air gap, and wherein the deflector means includes a web located between the air gap and the backflow opening to intercept and direct out of the backflow opening any backflowing waste water.

4. Air gap apparatus according to claim 1 wherein the nozzle means is located out of vertical alignment with the lower terminus of the deflector means to place the nozzle means out of the direct path of any backflowing waste water.

5. Air gap apparatus according to claim 1 and including a flow director located adjacent the outlet passage, and below the lower terminus of the deflector means, the flow director being operative to direct any backflowing waste water against the deflector means.

6. Air gap apparatus according to claim 1 wherein the housing means includes supplemental vent passage means providing communication between the air gap chamber and atmosphere.

7. Air gap apparatus comprising:

housing means defining a chamber having interior walls, a nozzle passage, an outlet passage, an air gap venting the chamber to atmosphere and tending to prevent back siphonage into the chamber of waste water from the outlet passage, and further having a backflow opening located below the air gap; and a deflector wall located below the nozzle passage, and extending between the nozzle passage and the outlet passage to intercept and to deflect out of the backflow opening any waste water which backflows forcibly upwardly from the outlet passage.

8. Air gap apparatus according to claim 7 wherein the air gap has an upper terminus and a lower terminus, and the deflector wall extends inwardly and downwardly from the lower terminus of the air gap, and including a splatter shield located between the nozzle passage and the air gap.

9. Air gap apparatus according to claim 7 wherein the air gap has an upper terminus and a lower terminus, and the deflector wall extends inwardly and downwardly from the upper terminus of the air gap to a point below the backflow opening to act as a splatter shield for the air gap, and wherein the deflector wall includes a web between the air gap and the backflow opening to intercept and outwardly direct any upwardly backflowing waste water.

10. Air gap apparatus according to claim 7 wherein the nozzle passage is located above and out of vertical alignment with the outlet passage.

11. Air gap apparatus according to claim 7 wherein the air gap has an upper terminus and a lower terminus, and including a flow director located adjacent the outlet passage and below the lower terminus of the deflector wall, the flow director being operative to direct any upwardly back-flowing waste water against the deflector wall.

12. Air gap apparatus according to claim 7 wherein the housing means includes supplemental vent passage means providing communication between the chamber and atmosphere.

13. Air gap apparatus according to claim 7 wherein the housing means supports nozzle and outlet fittings defining the nozzle and outlet passages, respectively, each of the nozzle and outlet fittings including a connector portion adapted to be forcibly fitted within the interior of semiflexible tubing, and having a plurality of longitudinally spaced apart, circumferentially continuous gripping ridges for engagement with the inner wall of the tubing, thereby constraining the fitting against longitudinal separation from the tubing and providing a fluid tight fit.

14. Air gap apparatus according to claim 7 wherein the housing means includes opposite connector portions adjacent the nozzle and outlet passages, respectively, adapted to be forcibly fitted within the interior of semiflexible tubing, and having a plurality of longitudinally spaced apart, circumferentially continuous gripping ridges for engagement with the inner wall of the tubing thereby to constrain the tubing and connector portions against separation.

15. Air gap apparatus according to claim 7 and including a debris screen coupled to and downstream of the outlet passage to prevent debris in any backflowing waste water from passing into the chamber.

16. Air gap apparatus according to claim 7 and including a connector portion coupled to the outlet passage of the housing means and having a backflow restrictor comprising a seat, a valve retainer and a valve supported upon the valve retainer, and the valve being operative to engage the seat in response to a backflow of waste water to constrain the backflowing waste water from flowing into the chamber.

17. Air gap apparatus according to claim 16 and including a debris screen in the connector portion downstream of the backflow restrictor to prevent debris in any backflowing waste water from passing into the backflow restrictor.

18. Air gap apparatus according to claim 16 wherein the valve is a buoyant ball shaped valve.

19. Air gap apparatus according to claim 7 wherein the housing means includes an outlet fitting defining the outlet passage, the outlet fitting including a plurality of gripping ridges for engagement with the inner wall of tubing for coupling to a waste conduit.

20. Air gap apparatus according to claim 7 wherein the housing means includes an inlet passage and connecting passages between the inlet passage and the nozzle passage outlet for conveying waste water to the nozzle passage for discharge into the chamber, and including turbulence reducing means disposed in certain ones of the connecting passages, the turbulence reducing means being operative to divide the stream of water flowing through the material into a multiplicity of streams.

21. Air gap apparatus according to claim 20 wherein the turbulence reducing means includes a plurality of adjacent walls operative to direct the streams of water along parallel paths in a laminar flow pattern.

22. Air gap apparatus according to claim 20 wherein the turbulence reducing means is a mesh material characterized by a plurality of interstices for forming the multiplicity of streams.

23. Air gap apparatus according to claim 7 wherein the housing means includes an inlet passage and a chamber for receiving water from the inlet passage, the chamber being larger than the inlet passage to cause the water to flow more slowly through the chamber and thereby reduce turbulence in the stream of water flowing into the nozzle passage.

24. Air gap apparatus according to claim 23 and including turbulence reducing means located in the chamber.

25. Air gap apparatus according to claim 24 wherein the size of the nozzle passage is greater than the size of the inlet passage whereby debris particles in the water passing through the inlet passage will have no difficulty passing through the nozzle passage.

26. Air gap apparatus according to claim 7 wherein the deflector wall includes a lower end spaced from the housing means to define the exit passage, and wherein the housing means includes a nozzle fitting defining the nozzle passage, the housing means and the nozzle fitting being configured to angularly orient the axis of the nozzle passage to direct the stream of water flowing from the nozzle passage directly toward the exit passage.

27. Air gap apparatus according to claim 7 wherein the chamber includes a plurality of the nozzle passages, and further includes a nozzle chamber leading into the nozzle passages, the plurality of nozzle passages having inlet ends disposed at different heights in the nozzle chamber, respectively, whereby successive ones of the plurality of passages receive waste water as the level of accumulated waste water rises in the nozzle chamber.

28. Air gap apparatus comprising:

housing means defining a chamber having an inlet passage, a nozzle passage, an outlet passage, an air gap venting the chamber to atmosphere and tending to prevent back siphonage into the chamber of waste water from the outlet passage, and further having a backflow opening located below the air gap; and a deflector wall located below the nozzle passage and oriented to direct out of the backflow opening any waste water which backflows upwardly from the outlet passage; and an upwardly open backflow preventer retained between the air gap and the backflow opening for collecting the directing water downwardly, and including a flexible and collapsible lower end adapted to pass water in a downstream direction toward the outlet passage, and also adapted to collapse and prevent water from flowing in an upstream direction.

29. Air gap apparatus comprising:

housing means defining an air gap chamber and a backflow chamber having, respectively, an air gap having an upper terminus and a lower terminus, and further having a backflow opening having an upper terminus and a lower terminus; and a deflector wall extending between the air gap and the backflow chamber, the deflector wall being operative to downwardly pass waste water from the air gap chamber, and further operative to intercept and deflect out of the backflow opening any waste water which reversely flows forcibly into the backflow chamber.

30. Air gap apparatus according to claim 29 where the lower margin defining the backflow opening is lower than the lower margin defining the air gap.

* * * * *